US006712101B1

(12) United States Patent
Nanaji

(10) Patent No.: US 6,712,101 B1
(45) Date of Patent: Mar. 30, 2004

(54) HYDROCARBON SENSOR DIAGNOSTIC METHOD

(75) Inventor: Seifollah S. Nanaji, Greensboro, NC (US)

(73) Assignee: Gilbarco Inc., Greensboro, NC (US)

( * ) Notice: Subject to any disclaimer, the term of this patent is extended or adjusted under 35 U.S.C. 154(b) by 0 days.

(21) Appl. No.: 09/442,260

(22) Filed: Nov. 17, 1999

(51) Int. Cl.[7] ..... B67D 5/32

(52) U.S. Cl. ..... 141/83; 141/7; 141/59; 141/94; 141/290

(58) Field of Search ..... 141/7, 47, 59, 141/83, 94, 290, 392; 73/1.07, 1.03, 1.06

(56) References Cited

U.S. PATENT DOCUMENTS

| | | | | |
|---|---|---|---|---|
| 4,095,626 A | | 6/1978 | Healy | 141/206 |
| 4,392,870 A | | 7/1983 | Chieffo et al. | 55/20 |
| 4,508,127 A | | 4/1985 | Thurston | 137/8 |
| 4,779,446 A | * | 10/1988 | Rowland | 205/785.5 |
| 4,949,755 A | | 8/1990 | Thurston et al. | 137/833 |
| 5,010,322 A | * | 4/1991 | Fry et al. | 340/700 |
| 5,079,944 A | | 1/1992 | Boenning et al. | 73/23.4 |
| 5,127,173 A | | 7/1992 | Thurston et al. | 72/202 |
| 5,150,603 A | | 9/1992 | Boenning et al. | 73/31.05 |
| 5,156,199 A | | 10/1992 | Hartsell, Jr. et al. | 141/83 |
| 5,195,564 A | | 3/1993 | Spalding | 141/1 |
| 5,269,353 A | | 12/1993 | Nanaji et al. | 141/59 |
| 5,309,957 A | | 5/1994 | Saisuu | 141/83 |
| 5,323,817 A | | 6/1994 | Spalding | 141/1 |
| 5,332,008 A | | 7/1994 | Todd et al. | 141/5 |
| 5,332,011 A | | 7/1994 | Spalding | 141/59 |
| 5,345,979 A | | 9/1994 | Tucker et al. | 141/1 |
| 5,355,915 A | | 10/1994 | Payne | 141/83 |
| 5,363,988 A | | 11/1994 | Saxton et al. | 222/14 |
| 5,373,822 A | | 12/1994 | Thompson | 123/520 |
| 5,417,256 A | | 5/1995 | Hartsell, Jr. et al. | 141/7 |
| 5,429,159 A | | 7/1995 | Tees et al. | 141/59 |
| 5,450,883 A | | 9/1995 | Payne et al. | 141/59 |
| 5,464,466 A | | 11/1995 | Nanaji et al. | 95/45 |
| 5,507,325 A | | 4/1996 | Finlayson | 141/83 |
| RE35,238 E | | 5/1996 | Pope | 141/159 |
| 5,515,714 A | | 5/1996 | Sultan et al. | 73/25.01 |

(List continued on next page.)

FOREIGN PATENT DOCUMENTS

| | | |
|---|---|---|
| WO | WO 96/06038 A1 | 2/1996 |
| WO | WO 97/43204 | 11/1997 |
| WO | WO 98/31628 | 7/1998 |
| WO | WO 00/55047 | 9/2000 |

OTHER PUBLICATIONS

"ORVR/Stage II Compatibility: Keeping Onboard and Vac–Assist Systems From Pulling in Opposite Directions," *Critical Issues*, vol. 8, No. 1, Copyright 1997. OPW Fueling Components.

"Determinination (By Volume Meter) of Air To Liquid Volume Ratio of Vapor Recovery Systems of Dispensing Facilities," Vapor recovery Test Procedure, California Environmental Protection Agency Air Resources Board, Proposed TP201.5, Adopted Apr. 12, 1996.

(List continued on next page.)

*Primary Examiner*—Gregory L. Huson
*Assistant Examiner*—Peter deVore
(74) *Attorney, Agent, or Firm*—Withrow & Terranova PLLC

(57) ABSTRACT

A vapor recovery system in a fuel dispenser includes the ability to self diagnose the continued viability of a hydrocarbon sensor positioned within the vapor recovery system. A control system associated with the vapor recovery system performs a series of tests including passing pure air over the hydrocarbon sensor and passing a gas known to have hydrocarbons therein over the sensor and evaluating the output of the sensor to see if expected values are output. If the measured values are not within tolerable limits, an alarm is generated.

38 Claims, 3 Drawing Sheets

U.S. PATENT DOCUMENTS

| | | | | |
|---|---|---|---|---|
| 5,571,310 | A | 11/1996 | Nanaji | 96/4 |
| 5,592,979 | A | 1/1997 | Payne et al. | 141/59 |
| 5,626,649 | A | 5/1997 | Nanaji | 95/12 |
| 5,629,477 | A | 5/1997 | Ito | 73/118.1 |
| 5,644,069 | A | 7/1997 | Liu et al. | 73/23.2 |
| 5,671,785 | A | 9/1997 | Andersson | 141/59 |
| 5,673,732 | A | 10/1997 | Kenney et al. | 141/59 |
| 5,675,073 | A | 10/1997 | Otsuka | 73/40.5 R |
| 5,706,871 | A | 1/1998 | Andersson et al. | 141/59 |
| 5,715,875 | A | 2/1998 | Clary et al. | 141/59 |
| 5,726,354 | A | 3/1998 | Nomura et al. | 73/118.1 |
| 5,753,933 | A | 5/1998 | Morimoto | 257/14 |
| 5,765,603 | A | 6/1998 | Healy | 141/59 |
| 5,769,134 | A | 6/1998 | Kenney et al. | 141/59 |
| 5,779,097 | A | 7/1998 | Olson et al. | 222/39 |
| 5,782,275 | A | 7/1998 | Hartsell, Jr. et al. | 141/94 |
| 5,832,967 | A | 11/1998 | Andersson | 141/59 |
| 5,857,500 | A | 1/1999 | Payne et al. | 141/59 |
| 5,860,457 | A | 1/1999 | Andersson | 141/59 |
| 5,913,343 | A | 6/1999 | Andersson | 141/59 |
| 5,944,067 | A | 8/1999 | Andersson | 141/59 |
| 5,988,232 | A * | 11/1999 | Koch et al. | 141/59 |

OTHER PUBLICATIONS

"Determination of Efficiency of Phase II Vapor Recover Systems of Dispensing Facilities," Vapor Recovery Test Procedures, California Environmental Protection Agency Air Resources Board, Proposed TP–201.2, Adopted Apr. 12, 1996.

"Stage II Vapor Recovery Vacuum Pumps," Fenner Fluid Power, Nov., 1998.

Pope, Kenneth L., Nanaji, Seify N., Sobota, Richard R., "Fuel Dispenser Vapor Recovery System Employing Microanemometer Technology For Vapor Flow Meter," Invention Disclosure to Gilbarco Inc., 1998.

"Refueling Emissions Can Be Controlled", Automotive Engineering, May 1976, 6 pages.

* cited by examiner

HYDROCARBON SENSOR DIAGNOSTIC METHOD

BACKGROUND OF THE INVENTION

1. Field of the Invention

This invention pertains to a diagnostic method for checking the accuracy of a hydrocarbon sensor in a vapor recovery system, such as in a fuel dispensing environment.

2. Description of the Related Art

Vapor recovery equipped fuel dispensers, particularly gasoline dispensers, have been known for quite some time, and have been mandatory in California for a number of years. The primary purpose of using a vapor recovery fuel dispenser is to retrieve or recover the vapors, which would otherwise be emitted to the atmosphere during a fueling operation, particularly for motor vehicles. The vapors of concern are generally those which are contained in the vehicle gas tank. As liquid gasoline is pumped into the tank, the vapor is displaced and forced out through the filler pipe. Other volatile hydrocarbon liquids raise similar issues. In addition to the need to recover vapors, some states, California in particular, are requiring extensive reports about the efficiency with which vapor is recovered and proof that the vapor recovery systems are working as intended.

A traditional vapor recovery apparatus is known as the "balance" system, in which a sheath or boot encircles the liquid fueling spout and connects by tubing back to the fuel reservoir. As the liquid enters the tank, the vapor is forced into the sheath and back toward the fuel reservoir or underground storage tank (UST) where the vapors can be stored or recondensed. Balance systems have numerous drawbacks, including cumbersomeness, difficulty of use, ineffectiveness when seals are poorly made, and slow fueling rates.

As a dramatic step to improve on the balance systems, Gilbarco, Inc., assignee of the present invention, patented an improved vapor recovery system for fuel dispensers, as seen in U.S. Pat. No. 5,040,577, now Reissue Patent No. 35,238 to Pope, which is herein incorporated by reference. The Pope patent discloses a vapor recovery apparatus in which a vapor pump is introduced in the vapor return line and is driven by a variable speed motor. The liquid flow line includes a pulser, conventionally used for generating pulses indicative of the liquid fuel being pumped. This permits computation of the total sale and the display of the volume of liquid dispensed and the cost in a conventional display, such as, for example as shown in U.S. Pat. No. 4,122,524 to McCrory et al. A microprocessor translates the pulses indicative of the liquid flow rate into a desired vapor pump operating rate. The effect is to permit the vapor to be pumped at a rate correlated with the liquid flow rate so that, as liquid is pumped faster, vapor is also pumped faster.

There are three basic embodiments used to control vapor flow during fueling operations. The first embodiment is the use of a constant speed vapor pump during fueling without any sort of control mechanism. The second is the use of a pump driven by a constant speed motor coupled with a controllable valve to extract vapor from the vehicle gas tank. While the speed of the pump is constant, the valve may be adjusted to increase or decrease the flow of vapor. The third is the use of a variable speed motor and pump as described in the Pope patent, which is used without a controllable valve assembly.

Various improvements and refinements have been developed to make vapor recovery systems more efficient and provide a better estimate of the type and rate of vapor recovery. Amongst these improvements are vapor flow meters, such as disclosed in commonly owned copending U.S. patent application Ser. No. 09/408,292. Additionally, the use of hydrocarbon sensors positioned within the vapor recovery line is also known as shown in commonly owned U.S. Pat. No. 5,857,500 and its parent U.S. Pat. No. 5,450,883, which are herein incorporated by reference. As the use of such sensors proliferates in the industry, it is being discovered that these sensors deteriorate with age, or otherwise may have their performance degrade over time. Therefore, there is a need for the ability to test the sensors to determine if they are still functioning properly. Additionally, as states begin to require proof that the vapor recovery systems are functioning properly, the ability to test the vapor recovery system is becoming more important.

SUMMARY OF THE INVENTION

The present invention periodically tests a sensor for determining hydrocarbon concentration within a vapor recovery system for proper operation. Specifically, the control system which controls the vapor recovery system within a fuel dispenser, checks the reading on the sensor every fueling transaction at the beginning of the fueling transaction and at a subsequent time during the same fueling transaction. If the two readings are roughly equivalent, the control system determines if this is the appropriate fueling transaction to trigger a more comprehensive diagnostic test of the sensor. If an appropriate number of fueling transactions have occurred since the last full diagnostic test, the sensor checks to see if the last measured value of hydrocarbon concentration is within an expected range. Further, the diagnostics test the readings of the sensor against a flow of pure air, to make sure that the last measured value is greater than that of pure air. Still further, the sensor can test itself by measuring a flow of vapor known to contain hydrocarbons and comparing the resultant reading to an expected value. If any of these diagnostic tests fail, the control system may generate an alarm indicating that the sensor has potentially failed and needs to be serviced or examined further to determine the cause of the failure.

DETAILED DESCRIPTION OF THE INVENTION

Figure 1:
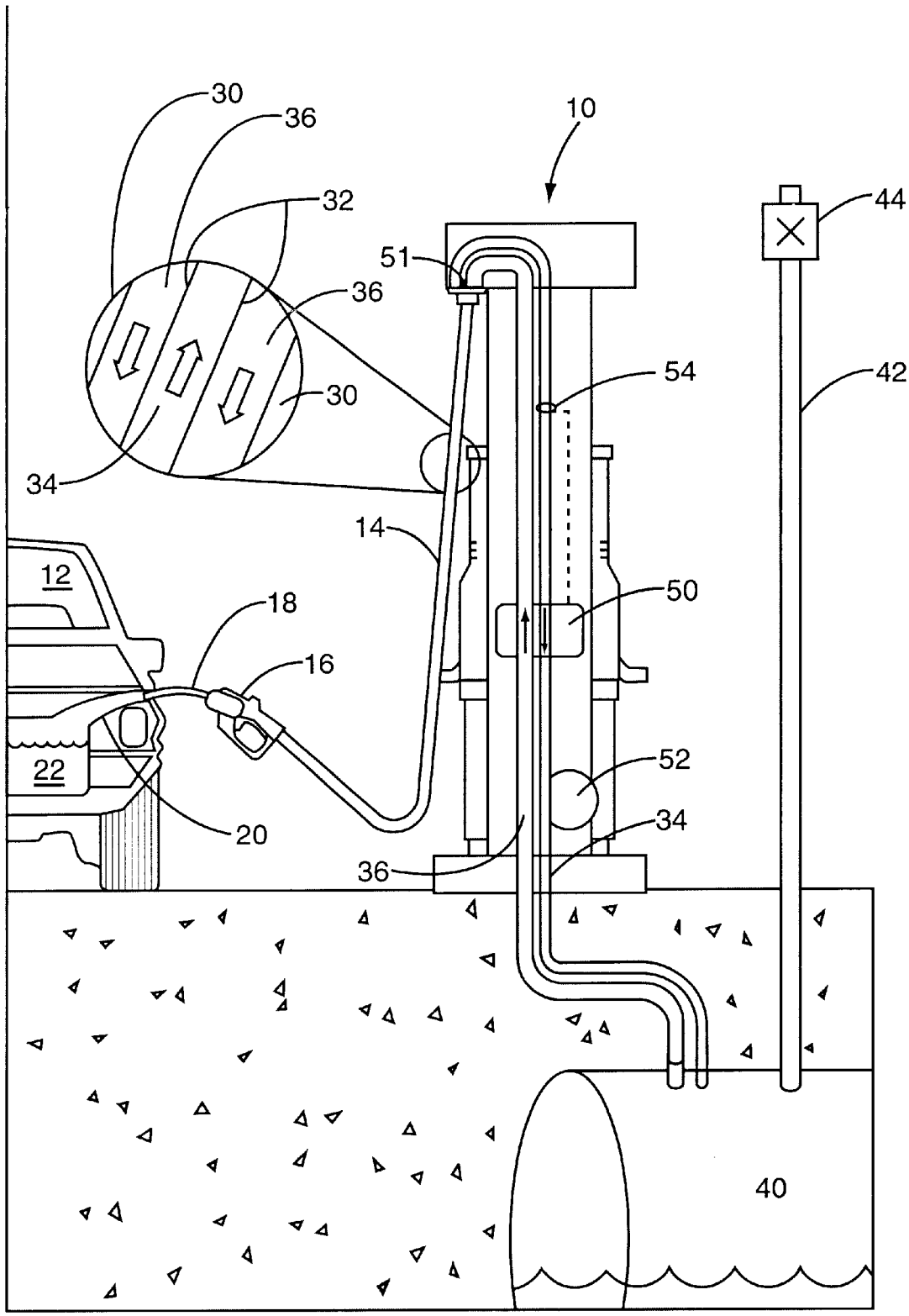
FIG. 1 is a schematic view of a fuel dispenser incorporating a vapor recovery system.

Turning now to FIG. 1, a fuel dispenser 10 is adapted to deliver a fuel, such as gasoline or diesel fuel to a vehicle 12 through a delivery hose 14, and more particularly through a nozzle 16 and spout 18. The vehicle 12 includes a fill neck 20 and a tank 22, which accepts the fuel and provides it through appropriate fluid connections to the engine (not shown) of the vehicle 12.

Presently, it is known in the field of vapor recovery to provide the flexible delivery hose 14 with an outer conduit 30 and an inner conduit 32. The annular chamber formed between the inner and outer conduits 30, 32 forms the product delivery line 36. The interior of the inner conduit 32 forms the vapor return line 34. Both lines 34 and 36 are fluidly connected to an underground storage tank (UST) 40 through the fuel dispenser 10. Once in the fuel dispenser 10, the lines 34 and 36 separate at split 51. The UST 40 is equipped with a vent shaft 42 and a vent valve 44. During delivery of fuel into the tank 22, the incoming fuel displaces air containing fuel vapors. The vapors travel through the vapor return line 34 to the UST 40.

A vapor recovery system is present in the fuel dispenser 10 and includes a control system 50 and a vapor recovery pump 52. Control system 50 may be a microprocessor with an associated memory or the like and also operates to control the various functions of the fuel dispenser including, but not limited to: fuel transaction authorization, fuel grade selection, display and/or audio control. The vapor recovery pump 52 may be a variable speed pump or a constant speed pump with or without a controlled valve (not shown) as is well known in the art. A hydrocarbon sensor 54, such as that disclosed in the previously incorporated, commonly owned U.S. Pat. No. 5,857,500 and its parent U.S. Pat. No. 5,450,883 or the equivalent sensor is positioned in the vapor recovery line 34 and communicatively connected to the control system 50.

Sensor 54 may also be an alternative sensor which through the detection of other vapor within the vapor return line 34 indirectly measures the level of hydrocarbon concentration within vapor return line 34. Such a sensor may sense the oxygen concentration, the nitrogen concentration, or other appropriate gas and from that reading the control system 50 may determine a hydrocarbon concentration. For example, hydrocarbon concentration would be inversely proportional to oxygen or nitrogen concentration. The determination would be precalibrated to provide an accurate indication of hydrocarbons based on the measured level of the gas in question.

While the sensor 54 is depicted in the vapor recovery line 34 upstream of the vapor pump 52, other placements of the sensor 54 are also possible. For example, the sensor 54 could be in a parallel vapor recovery path to reduce the likelihood of exposure to liquid fuel; the sensor 54 could be downstream of the vapor pump 52; sensor 54 could be placed in the ventilation line 42 or the like as needed or desired. Additionally, although a particular arrangement is shown for the vapor recovery system, it should be appreciated that other arrangements are possible, and the present invention encompasses all vapor recovery systems that include a sensor for determining hydrocarbon concentration.

Figure 2:
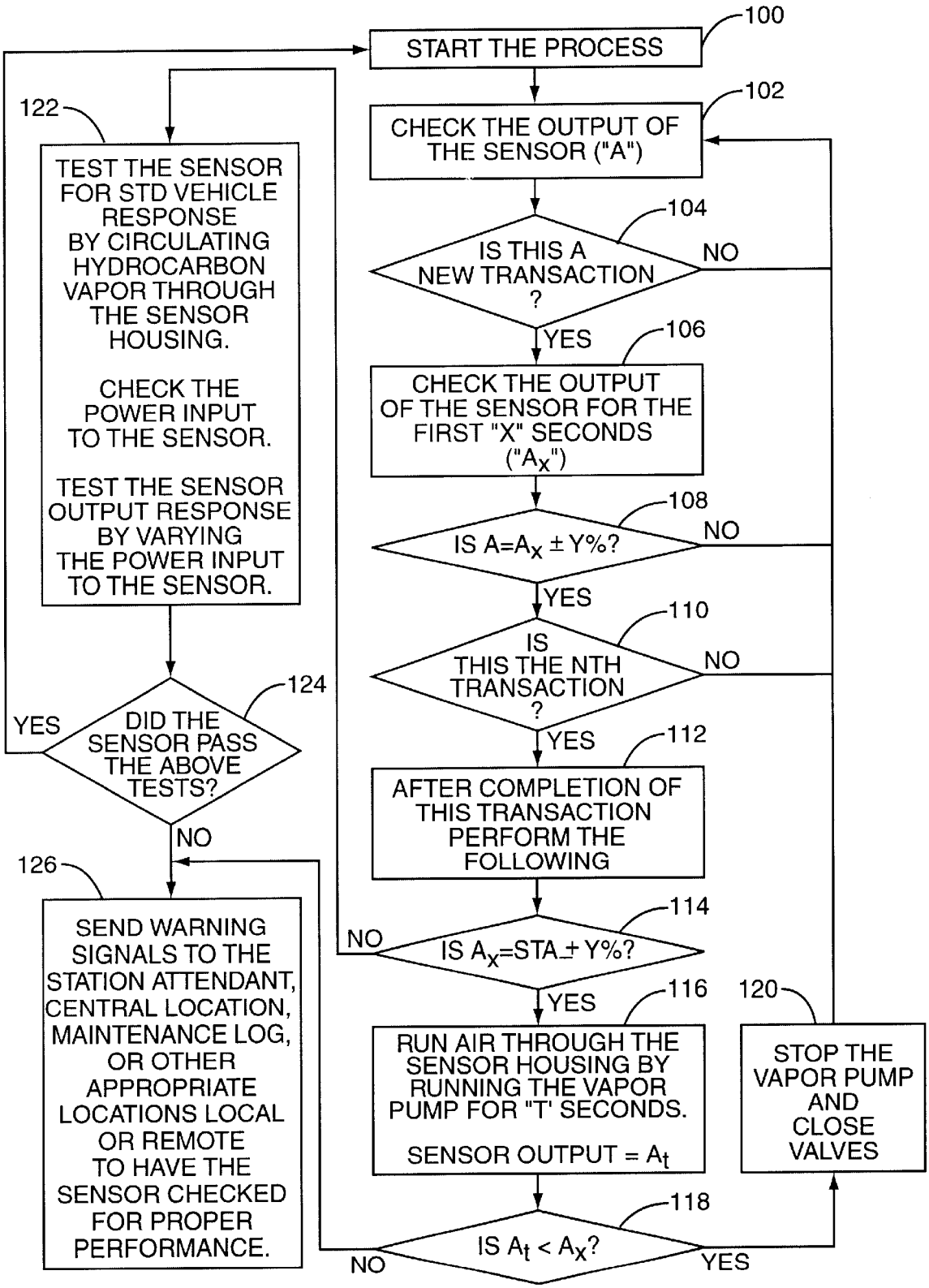
FIG. 2 is a flow diagram of the diagnostics performed by the present invention.

As noted, sensor 54 may deteriorate over time as a result of the harsh environment in which it is positioned, or a state regulatory commission may require proof that the vapor recovery system is working as intended. Therefore, it is imperative that the operator of the fueling station have some means to ascertain the accuracy of any readings provided by the sensor 54. The present invention addresses this concern by providing a diagnostic routine performed by the control system 50 of the fuel dispenser 10 as shown in FIG. 2. The diagnostics are designed to check the output of the sensor 54 against an expected output for a fueling transaction and further check the output of the sensor 54 to see if it varies as a result of varying input conditions. The diagnostic tests are preferably performed at predetermined intervals based on the number of fueling transactions that the sensor 54 has endured.

The process starts (block 100) when a fueling transaction begins or at some other predetermined time as needed or desired, such as five seconds after a fueling transaction begins. Further the definition of a the beginning of a fueling transaction is not necessarily when payment is authorized, but rather is preferably the time at which fuel begins to be dispensed. At the time the process starts, the output of sensor 54 is checked by the control system 50 (block 102). A reading of the sensor 54 is labeled A.

The control system 50 then determines if this is a new transaction (block 104). If the answer to block 104 is no, the process restarts at block 102. If the answer to block 104 is yes, the control system 50 checks the output of the sensor 54 after a predetermined amount of time, for example after "X" seconds and labels this output $A_x$ (block 106). In the preferred embodiment, X is approximately 10 to 20 seconds, although other time frames are also contemplated. The average fueling transaction for a private vehicle is approximately two minutes in length. The average fueling transaction for a tractor-trailer or large commercial vehicle is substantially longer. X is preferably less than the expected length of the fueling transaction.

The control system 50 then determines if A equals $A_x \pm Y$ %, wherein Y % is a predetermined confidence interval (block 108). This tests to see if the sensor 54 is getting a consistent reading from the vapor recovery line. Further, this may help determine if there is an Onboard Recovery Vapor Recovery system present. If an inconsistent reading is rendered, this anomaly is generally indicative that the sensor 54 is working, and the error, if there is one, may lie in other hardware within the system. However, additional diagnostics could be performed if desired or needed prior to restarting at block 102 as will be explained below.

Absent these potential additional diagnostics, if the answer to block 108 is no, then the diagnostic process restarts at block 102. If the answer to block 108 is yes, then the control system 50 determines if this is the Nth transaction, where N is a predetermined number, preferably between 50 and 200 (block 110), although other ranges from 3 to 10,000 or larger are also feasible. In one embodiment, the number would be empirically calculated to correspond to testing the system approximately once a day. If the answer to block 110 is no, the process restarts at block 102. Thus, the control system 50 may only run the diagnostic tests every Nth fueling transaction. A memory or counter associated with the control system 50 can easily be implemented to keep track of the number of transactions since the last diagnostic test.

In the preferred embodiment, multiple measurements are taken during a fueling transaction, even if $A=A_x \pm Y$ % and it is not the Nth transaction. This is a result of decisional logic shown in FIG. 2. Sensor 54 takes an initial reading A at the beginning of the fueling transaction. Block 104 is answered affirmatively, that this is a new transaction. A subsequent reading is taken to create $A_x$. If A does not roughly equal $A_x$, a third reading is taken when the routine cycles back to block 102. Fourth and more readings are taken as the routine cycles through blocks 102 and 104 until the end of the fueling transaction. Even if $A=A_x \pm Y$ %, but this is not the Nth transaction, a third reading is taken when the routine cycles back to block 102. Again, fourth and more readings are taken as the routine cycles through blocks 102 and 104 until the end of the fueling transaction. All of these readings can be stored in memory associated with the control system 50 to track the performance of the sensor 54 over the course of many fueling transactions. These historical data points can be used to evaluate when a sensor 54 failed, or extrapolate a linear degradation curve associated with the sensor 54 or the like. Some states may require such data to show vapor recovery rates or the like. However, if this data is determined to not be helpful, it may be deleted as needed or desired.

While it is useful to have this information, this still does not test per se if the sensor 54 is functioning properly. Thus every Nth transaction, the control system 50 runs a more in depth diagnostic test.

If the answer to block 110 is yes, enough transactions have elapsed to necessitate a new test of the sensor 54, the control system 50 waits until the end of the presently occurring fueling transaction (block 1 12) and proceeds to run a more in depth diagnostic test. At the conclusion of the Nth fueling transaction, the control system 50 determines if $A_x$=STA±Y %, wherein STA is the typical hydrocarbon concentration in the fill-neck 20 of the vehicle 12 (block 114). This step determines if the sensor 54 is getting an expected reading within a predetermined confidence interval. If the answer to block 114 is yes, the control system 50 then instructs the fuel dispenser 10 to run air through the vapor recovery system, and more particularly through the vapor return line 34 by operating the vapor recovery pump 52 for a predetermined amount of time (labeled "T"). Sensor 54 then takes a subsequent reading while air is passing over the sensor 54 (labeled At) (block 116). The control system 50 then determines if $A_t<A_x$ (block 118). This step verifies that $A_x$, the concentration of hydrocarbons within the vapor recovery line 34 during a fueling transaction, is greater than a value corresponding to what the sensor 54 reads when pure air is passed thereover. If the answer to block 118 is yes, the control system 50 stops the vapor recovery pump 52 and closes any valves associated therewith (block 120). The diagnostic test resumes at block 102 as previously described. The diagnostic test has confirmed that the sensor 54 is operating as intended, and no further action is immediately required.

If the answer to block 114 is no, $A_x$ is not within a predetermined acceptable range, the control system 50 instructs the sensor 54 to perform a series of self diagnostic tests to determine whether the sensor 54 is presently working. Specifically, the sensor 54 has gas known to have hydrocarbon vapor therein passed over the sensor 54, and the response of the sensor 54 is measured. If no hydrocarbons are detected, there is a problem with the sensor 54. Passing hydrocarbon laden gas over the sensor 54 can be achieved by reversing the flow of pump 52 for a few seconds, preferably approximately 10 seconds. This brings vapor from the UST 40 to the sensor 54. Alternatively, a pipe with a valve may be positioned upstream of the sensor 54 and connect the vapor return line 34 to the UST 40 (not shown). The valve can be opened and the pump 52 operated as normal to draw vapor from the UST 40 past the sensor 54 and back to the UST 40. This gas with known vapors therein should register on the sensor 54. If no hydrocarbons are detected, the sensor 54 has probably suffered a failure of some sort. Finally, gas with known hydrocarbon vapor may be introduced to the vapor return line 34 manually.

Further, the control system 50 checks the power input to the sensor 54. Turning the power off and on again can do this. Some sort of change in the reading provided by sensor 54 should be achieved in response to this power fluctuation. Still further, the control system 50 tests the sensor 54 output by varying the power input to the sensor 54 (block 122). In sensors 54 with an optical element or a heating element, the element's intensity will vary according to the power input. For example, an LED may glow with a greater intensity as the power is increased; the receptor should reflect this greater intensity. If the readings gathered by sensor 54 do not vary as a result of the variance of the power input, the sensor 54 may have failed. Control system 50 determines if the sensor 54 passed the tests enumerated in block 122 (block 124). If the answer to block 124 is yes, the control system 50 determines that the answer to block 114 was an anomaly and restarts the diagnostic process at block 100. If however, the answer to block 124 is no, or the answer to block 118 is no, then control system 50 sends an appropriate warning signal to one or more of the following locations: the station attendant, a central office location, a maintenance log, or other appropriate locations local or remote to the fuel dispenser 10 wherein the warning signal includes an instruction to check further, and preferably manually, the sensor 54 for proper performance (block 126).

Figure 3:
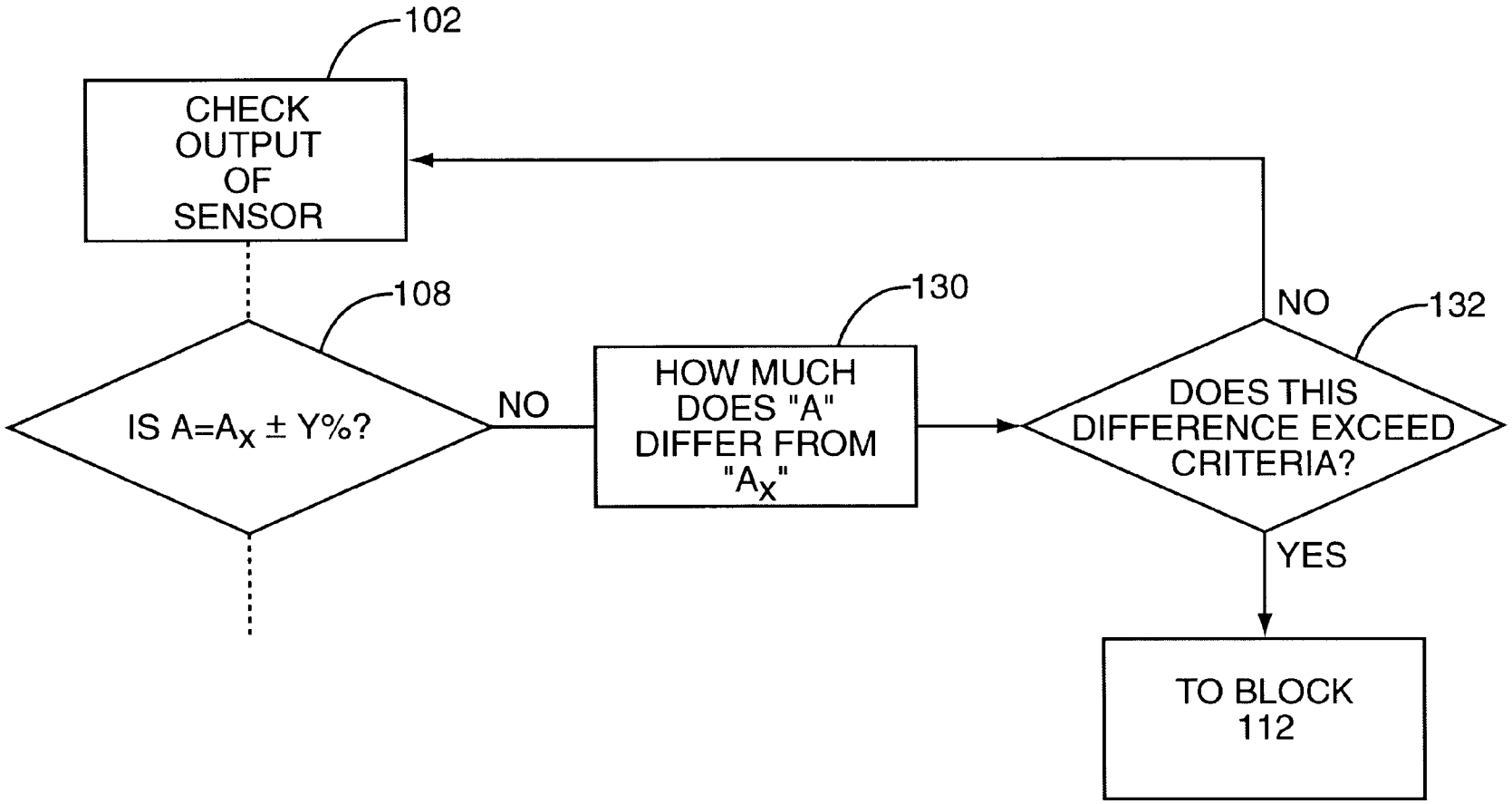
FIG. 3 is a flow diagram of an alternate set of diagnostics that could be implemented with the present invention.

There are occasions when A will dramatically fluctuate compared to $A_x$. Further diagnostics may be required to ascertain whether the result was an anomaly or whether the sensor 54 is in fact not functioning properly. This optional diagnostic routine is seen in FIG. 3. The control system 50 determines how much A differs from $A_x$ (block 130). The control system 50 then determines if this difference exceeds some preselected criteria. If the answer is no, the results of block 108 are viewed as a random anomaly and the process restarts at block 102. If the answer is yes, then the control system 50 proceeds with further diagnostic testing at block 112.

While shown as being positioned within the fuel dispenser 10, it should be appreciated that the control system 50 could be remote from the fuel dispenser 10, such as in the gas station building or the like as needed or desired. Further the sensor 54 could be positioned in a number of places within the vapor recovery system as needed or desired. The diagnostic routine described herein could be implemented through software associated with said control system 50, or it could be performed by dedicated hardware or the like as needed or desired.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method for diagnosing an operative status of a system for determining hydrocarbon concentration in a vapor recovery system, said method comprising:

delivering fuel through a fuel dispenser during a fueling transaction;

recovering vapor during said fueling transaction;

measuring the hydrocarbon concentration in the recovered vapor by examining a first output of a sensor in said system for determining hydrocarbon concentration; and periodically performing a diagnostic test on said sensor to evaluate the performance of said sensor, wherein the step of performing a diagnostic test on said sensor comprises passing air lacking hydrocarbons over said sensor to create a second output of said sensor and comparing the first output to the second output.

2. The method of claim 1 further comprising the step of determining if the second output is less than the first output.

3. The method of claim 2 further comprising the step of terminating the diagnostic test if the second output is less than the first output.

4. The method of claim 2 further comprising the step of generating an alarm if the second output is greater than the first output.

5. The method of claim 1 further comprising the step of generating an alarm if said sensor fails said diagnostic test.

6. A method for diagnosing an operative status of a system for determining hydrocarbon concentration in a vapor recovery system, said method comprising:

delivering fuel through a fuel dispenser during a fueling transaction;

recovering vapor during said fueling transaction;

measuring the hydrocarbon concentration in the recovered vapor by examining a first output of a sensor in said system for determining hydrocarbon concentration; and periodically performing a diagnostic test on said sensor to evaluate the performance of said sensor, wherein the step of performing a diagnostic test on said sensor comprises passing air known to contain hydrocarbons over said sensor and evaluating a second output from said sensor.

7. The method of claim 6 further comprising the step of generating an alarm if said sensor fails said diagnostic test.

8. A method for diagnosing an operative status of a system for determining hydrocarbon concentration in a vapor recovery system, said method comprising:

delivering fuel through a fuel dispenser during a fueling transaction;

recovering vapor during said fueling transaction;

measuring the hydrocarbon concentration in the recovered vapor by examining a first output of a sensor in said system for determining hydrocarbon concentration; and periodically performing a diagnostic test on said sensor to evaluate the performance of said sensor, wherein the step of performing a diagnostic test on said sensor comprises checking a power input to said sensor.

9. The method of claim 8 further comprising the step of generating an alarm if said sensor fails said diagnostic test.

10. A method for diagnosing an operative status of a system for determining hydrocarbon concentration in a vapor recovery system, said method comprising:

delivering fuel through a fuel dispenser during a fueling transaction;

recovering vapor during said fueling transaction;

measuring the hydrocarbon concentration in the recovered vapor by examining a first output of a sensor in said system for determining hydrocarbon concentration; and periodically performing a diagnostic test on said sensor to evaluate the performance of said sensor, wherein the step of performing a diagnostic test on said sensor comprises the steps of varying a power input to said sensor and checking the output of said sensor to determine if the output varies in response to the varying power input.

11. The method of claim 10 further comprising the step of generating an alarm if said sensor fails said diagnostic test.

12. A method for diagnosing an operative status of a system for determining hydrocarbon concentration in a vapor recovery system, said method comprising:

delivering fuel through a fuel dispenser during a fueling transaction;

recovering vapor during said fueling transaction;

measuring the hydrocarbon concentration in the recovered vapor by examining a first output of a sensor in said system for determining hydrocarbon concentration;

periodically performing a diagnostic test on said sensor to evaluate the performance of said sensor; and during a single fueling transaction, comparing an initial output from said sensor with a subsequent output from said sensor.

13. The method of claim 12 further comprising the step of generating an alarm if said sensor fails said diagnostic test.

14. The method of claim 12 further comprising the step of determining if the initial output is within a predetermined range of the subsequent output.

15. The method of claim 12 further comprising the step of determining if the outputs are associated with a new transaction.

16. A method for diagnosing an operative status of a system for determining hydrocarbon concentration in a vapor recovery system, said method comprising:

delivering fuel through a fuel dispenser during a fueling transaction;

recovering vapor during said fueling transaction;

measuring the hydrocarbon concentration in the recovered vapor by examining a first output of a sensor in said system for determining hydrocarbon concentration;

periodically performing a diagnostic test on said sensor to evaluate the performance of said sensor; and determining if said first output is within a predetermined range.

17. A method for diagnosing an operative status of a system for determining hydrocarbon concentration in a vapor recovery system, said method comprising:

delivering fuel through a fuel dispenser during a fueling transaction;

recovering vapor during said fueling transaction;

measuring the hydrocarbon concentration in the recovered vapor by examining a first output of a sensor in said system for determining hydrocarbon concentration;

determining if said fueling transaction is a new fueling transaction;

measuring the hydrocarbon concentration in the recovered vapor by examining a second output of said sensor for determining hydrocarbon concentration;

determining if said first output is within a predetermined range of said second output;

determining if said fueling transaction is the appropriate fueling transaction to trigger a diagnostic test;

determining if said second output is within a predetermined range; and periodically performing a diagnostic test on said sensor to evaluate the performance of said sensor.

18. The method of claim 17 wherein performing a diagnostic test on said sensor comprises passing air known to contain hydrocarbons over said sensor and evaluating a second output from said sensor.

19. The method of claim 17 wherein performing a diagnostic test on said sensor comprises checking a power input to said sensor.

20. The method of claim 17 wherein performing a diagnostic test on said sensor comprises the steps of varying a power input to said sensor and checking the output of said sensor to determine if the output varies in response to the varying power input.

21. The method of claim 19 wherein performing a diagnostic test on said sensor comprises passing air lacking hydrocarbons over said sensor to create a second output of said sensor and comparing the first output to the second output.

22. A vapor recovery system comprising:

a) a vapor recovery line;

b) a sensor bearing on hydrocarbon concentration and producing an output indicative of hydrocarbon concentration within said vapor recovery line; and c) a control system associated with said vapor return system, wherein said control system periodically runs diagnostics to evaluate the performance of said sensor, wherein said control system evaluates the performance of said sensor by passing air substantially lacking hydrocarbons over said sensor to produce an output $A_t$ and comparing $A_t$ to an output derived during a fueling transaction.

23. The vapor recovery system of claim 22 wherein said sensor directly measures hydrocarbon concentration.

24. The vapor recovery system of claim 22 wherein said sensor indirectly measures hydrocarbon concentration.

25. The vapor recovery system of claim 23 wherein said sensor is positioned within said vapor recovery line.

26. The vapor recovery system of claim 22 wherein an alarm is generated if $A_t$ is greater than the output derived during a fueling transaction.

27. A vapor recovery system comprising:

a) a vapor recovery line;

b) a sensor bearing on hydrocarbon concentration and producing an output indicative of hydrocarbon concentration within said vapor recovery line; and c) a control system associated with said vapor return system, wherein said control system periodically runs diagnostics to evaluate the performance of said sensor, wherein said control system further compares an initial output associated with a beginning of a fueling transaction to a subsequent output associated with the same transaction.

28. The vapor recovery system of claim 27 wherein said control system determines if said initial output differs from said subsequent output to a degree exceeding predetermined criteria.

29. The vapor recovery system of claim 28 wherein said control system performs further diagnostic tests if said initial output differs from said subsequent output to a degree exceeding predetermined criteria.

30. The vapor recovery system of claim 29 wherein said further diagnostic tests comprise passing air known to contain hydrocarbon vapor over said sensor and evaluating an output to determine if said sensor is functioning.

31. The vapor recovery system of claim 29 wherein said further diagnostic tests comprise checking a power input to the sensor.

32. The vapor recovery system of claim 29 wherein said further diagnostic tests comprise varying a power input to the sensor and evaluating an output associated therewith for corresponding variance.

33. The vapor recovery system of claim 29 further comprising an alarm which signals said sensor failing said further diagnostic tests.

34. A fuel dispenser comprising:

a) a fuel delivery line; and b) a vapor recovery system associated with said fuel dispensing means, said vapor recovery system comprising:

i) a sensor bearing on a hydrocarbon concentration level;

ii) a vapor return line, said sensor associated with said vapor return line and capable of measuring hydrocarbon concentrations therein; and iii) a control system communicatively coupled to said sensor wherein said control system periodically tests said sensor to determine a present operating condition of said sensor, wherein said sensor passes an initial measurement to said control system and said control system determines if said sensor has measured a new transaction.

35. The fuel dispenser of claim 34, wherein said control system periodically evaluates the performance of said sensor.

36. The fuel dispenser of claim 35, wherein said control system further measures the concentration of hydrocarbons at a time subsequent to said initial measurement.

37. The fuel dispenser of claim 36, wherein said control system compares said initial measurement to said subsequent measurement.

38. The fuel dispenser of claim 37, wherein said comparison evaluates the proximity of said initial measurement to said subsequent measurement.

* * * * *